US007354541B2

(12) United States Patent
Bouquet et al.

(10) Patent No.: US 7,354,541 B2
(45) Date of Patent: Apr. 8, 2008

(54) METHOD AND DEVICE FOR MAKING MINERAL FIBER FELTS

(75) Inventors: Francois Bouquet, Rantigny (FR); Yannick Blandin, Breuil le Vert (FR); Alain Debouzie, Le Petit Couronne (FR)

(73) Assignee: Saint-Gobain Isover, Courbevoie (FR)

( * ) Notice: Subject to any disclaimer, the term of this patent is extended or adjusted under 35 U.S.C. 154(b) by 472 days.

(21) Appl. No.: 10/381,199

(22) PCT Filed: Sep. 26, 2001

(86) PCT No.: PCT/FR01/02978

§ 371 (c)(1),
(2), (4) Date: Oct. 14, 2003

(87) PCT Pub. No.: WO02/27090

PCT Pub. Date: Apr. 4, 2002

(65) Prior Publication Data

US 2004/0051205 A1 Mar. 18, 2004

(30) Foreign Application Priority Data

Sep. 27, 2000 (FR) ..... 00 12270

(51) Int. Cl.
*B29C 43/22* (2006.01)
*B29C 43/46* (2006.01)
*B29C 43/48* (2006.01)

(52) U.S. Cl. ..... 264/120; 65/443; 65/450; 65/455; 65/459; 65/517; 65/521; 65/529; 264/234; 264/236; 264/518; 425/83.1; 425/371; 425/446

(58) Field of Classification Search ..... 264/120, 264/236, 518, 234; 425/83.1, 371, 446; 65/443, 65/450, 529, 455, 459, 517, 521
See application file for complete search history.

(56) References Cited

U.S. PATENT DOCUMENTS 4,567,078 A 1/1986 Blackmore et al.

FOREIGN PATENT DOCUMENTS

| | | | |
|---|---|---|---|
| CH | 620 861 | A5 | 12/1980 |
| DE | 42 25 840 | C1 | 4/1994 |
| EP | 0 133 083 | A1 | 2/1985 |
| EP | 0 365 826 | A1 | 5/1990 |
| EP | 0 498 276 | A1 | 8/1992 |
| WO | 91 14816 | A1 | 10/1991 |

*Primary Examiner*—Leo B. Tentoni
(74) *Attorney, Agent, or Firm*—Oblon, Spivak, McClelland, Maier & Neustadt, P.C.

(57) ABSTRACT

The subject of the invention is a unit for manufacturing felts (6) which are formed from crosslinked mineral fibers, comprising at least one pair of conveyors formed by a lower conveyor (11) and an upper conveyor (12) which are placed opposite each other and intended to compress said felt (6) in at least one direction, a means (13) for heat treating the felt (6) after it has passed through the conveyors (11, 12) comprising at least one means (14) placed between the conveyors (11, 12) and the heat treatment means (13), intended to prevent decompression of the felt (6) in this region, said means comprising at least one cam (14) having a profile suitable for keeping a constant and minimum distance between the conveyors (11, 12) and the heat treatment means (13), and in that at least one of the conveyors is rigidly connected to one element of the heat treatment means (13).

43 Claims, 4 Drawing Sheets

METHOD AND DEVICE FOR MAKING MINERAL FIBER FELTS

BACKGROUND OF THE INVENTION

1. Field of the Invention

The invention relates to the formation of felts which are formed from mineral fibers and referred to by the generic names of glass wool, rock wool, etc.

2. Discussion of the Related Art

Conventionally, mineral fiber felts are made continuously by depositing the fibers on a conveyor, these being conveyed by gas streams. The conveyor retains the fibers and allows the gases to pass through them.

Before they are deposited on the conveyor, the fibers are coated with a composition applied in liquid form and intended to bond the fibers together, so as to give the subsequently formed felt its cohesion. Composition is then crosslinked by a heat treatment carried out on the felt, which has been conditioned beforehand to the desired thickness and density.

In addition to the insulating properties required very generally, it is also sometimes necessary for the products used to have very specific mechanical properties. This is the case, for example, with products which support masonry elements and which consequently have to withstand large compressive forces, such as elements used for the insulation of flat roofs. This is also the case with products used as exterior insulation which must in particular be able to withstand tearing forces.

To obtain products having these particular properties and other which will be seen later, it is necessary to modify the conventional processes for forming felts.

Forming felts by depositing fibers on the receiving conveyor or on a similar member results in an entanglement which is not uniform in all directions. Experimentally, it has been found that the fibers have a strong tendency to lie parallel to the receiving surface. This tendency is all the more accentuated the longer the fibers.

This structure of the felts is favorable to their insulating properties and to their tensile strength in the longitudinal direction. Consequently, such a structure is advantageous for many uses. However, it will be understood that such a structure is not best suited when, for example, the product has to withstand compression or tearing in its thickness direction.

To improve the compressive strength of these felts, one solution consists in increasing their density, by increasing the mass of fibers per unit surface on the receiving member where the felt is formed. Besides the fact that the mass of fibers per unit area that can be deposited is limited, the build-up of fibers on the receiving member rapidly preventing the flow of gases and therefore preventing the felt from continuing to be formed properly, which does not allow other properties such as the tear resistance to be improved.

Another solution already proposed consists in ensuring that the direction of the fibers lies not in the plane of the felt but in a plane perpendicular to it. This arrangement is achieved, for example, by forming pleats in the felt. These pleats are in particular obtained either by placing the felt in successive layers of greater or lesser length lying in the desired final thickness direction or by compressing the felt longitudinally. Due to the effect of the compression under the conditions envisaged, the felt forms corrugations. The heat treatment of the binder composition, which is carried out subsequently, gives this pleated structure permanence.

The direction of the fibers oriented in the thickness direction of the felt thus formed makes it possible to substantially improve the compressive strength and the tear strength. However, this structure is to the detriment of the longitudinal tensile strength—the felt has a tendency to unfold—or to the flexural strength.

The arrangement of the fibers in the thickness may also result from the assembly of strips of felt whose width corresponds to the desired thickness of the felt, each strip being placed so that the fibers lie in planes perpendicular to the faces of the felt formed. The strips are held against each other by means of a coating or a film covering one or both faces of the felt. Optionally, the strips may also be adhesively bonded directly to one another via their contacting surfaces.

The felts produced using this relatively complex technique, called "strip-webs", are used mainly for insulating large-diameter pipes. For this application, instead of constituting a disadvantage, the ability of the product obtained to bend and even to be wound is particularly desirable.

One solution to this problem is described in patent EP 0 133 083 filed in the name of the Applicant. The aim of this prior invention is to provide felts in which the mechanical properties, especially the compressive strength and tear strength in the thickness direction of the product, are improved without incurring the drawbacks encountered previously and consequently without forming pleats or assembling strips of felts; moreover, the mechanical and insulating properties of said felts remain satisfactory.

To do this, attempts have been made to obtain fibers (within the felt) having directions as varied as possible without correspondingly forming surface pleats. According to this prior art, the felt is subjected to at least one longitudinal compression operation and preferably to two operations of this type.

One problem associated with such manufacturing techniques resides in the homogeneity of the final felt and in particular in its surface homogeneity. This is because cracks, fracture initiators and/or localized swellings are observed on the surface, these being defects which are negative in terms of the mechanical and thermal behavior, without mentioning the unattractive appearance of the assembly.

This problem is essentially created in the region between the conveyor belts and the crosslinking oven.

In this region, the felt is no longer compressed so that it tends to loosen.

The aforementioned patent provides slideways in this region so as to ensure a certain continuity in holding the felt. However, the slideways are then additional and fragile elements, the more so as they are placed in the immediate vicinity of the oven, which is hot. Moreover, they must be positioned perfectly so as to ensure the desired continuity. In fact, this solution is not viable and the slideways pose more problems than they solve; this is why in practice this solution has been abandoned in favor of another solution, which constitutes the subject-matter of the present application.

BRIEF SUMMARY OF THE INVENTION

The present invention advantageously consists of a reliable and simple solution which completely solves the above-mentioned problem.

Thus, the subject of the present invention is a unit for manufacturing felts which are formed from crosslinked mineral fibers, comprising at least one pair of conveyors formed by a lower conveyor and an upper conveyor which are placed opposite each other and intended to compress said felt in at least one direction, a means for heat treating the felt after it has passed through the conveyors.

According to the invention, the unit furthermore includes at least one means placed between the conveyors and the heat treatment means, intended to prevent decompression of the felt in this region, as well as any mechanical interference, said means comprising at least one cam having a profile suitable for keeping a constant and minimum distance between the conveyors and the heat treatment means; at least one of the conveyors is rigidly connected to one element of the heat treatment means.

In particular, at least one of the conveyors is kept pressed against said cam by means such as cylinders.

Specifically, the cam is rigidly linked to one element of the heat treatment means, said element being able to move vertically and/or horizontally. The horizontal movement makes it possible to compensate for the thermal expansions.

According to one of the embodiments of the invention, the lower conveyor is rigidly connected to one element of the heat treatment means via a linking means.

According to one embodiment of the invention, said cam has a curved portion of curvature substantially identical to that of a wheel of the heat treatment means, said wheel being placed opposite the cam.

Specifically, the cam furthermore has a straight portion lying vertically below the curved portion and in that the cam bears on the upper conveyor.

Advantageously, the upper conveyor, the cam and the element of the heat treatment means to which it is linked can move vertically so as to be able to manufacture felts of different thicknesses.

The invention furthermore relates to a process for manufacturing felt formed from sized mineral fibers, consisting in particular in compressing the fibers in at least one direction and then in heat treating the fibers so as to stabilize them.

Characteristically, the process furthermore consists in preventing decompression of the fibers between the compression step and the heat treatment step, by means of a cam having a profile suitable for keeping a constant and minimum distance between the compression means and the heat treatment means.

Specifically, the compression means are kept pressed against said cam.

By way of illustration, the said felt is compressed longitudinally and/or in the thickness direction.

Advantageously, the present invention allows the manufacture of felts having thicknesses of between 10 and 500 mm.

The minimum distance between the compression means and the inlet of the oven is about 5 mm.

BRIEF DESCRIPTION OF THE DRAWINGS

Further features, details and advantages of the invention will become more clearly apparent on reading the description which follows, given by way of illustration but implying no limitation, with reference to the appended drawings in which.

DETAILED DESCRIPTION

Figure 1:
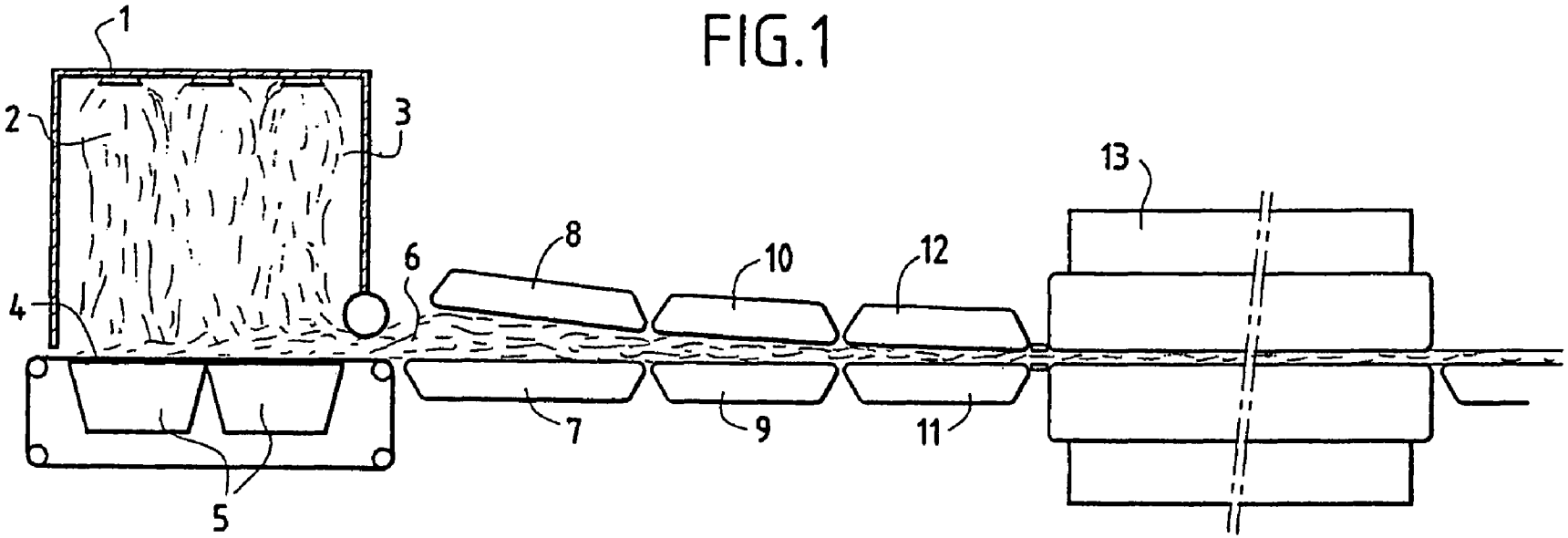
FIG. 1 is a diagram of one arrangement of a plant for manufacturing felts, comprising a unit according to the invention.

FIG. 1 shows the overall context in which the present invention may advantageously be employed.

This figure shows diagrammatically a line for manufacturing felts 6 formed from mineral fibers, also called rock wool or glass wool. In a known manner, such a line comprises one or more spinning devices 1 intended to form fibers 2 which are thrown off from the spinning device or devices 1 in a receiving chamber 3 at the base of which is placed a conveyor 4 onto which the fibers drop.

Preferably, one or more vacuum boxes 5 are located beneath the conveyor 4 so as to suck on and compact the fibers on the conveyor 4.

A web or felt 6 is thus formed; on leaving the chamber 3, the felt 6 is taken up between two conveyors 7, 8 intended to compress it in its thickness direction.

The felt 6 is then compressed longitudinally by passing between pairs of upstream conveyors 9, 10 and downstream conveyors 11, 12, the speeds of which are such that the speed of one pair, 11, 12, is less than the speed of the upstream pair 9, 10 (relative to the movement of the felt 6 through the conveyors).

Once the felt 6 has been compressed, it is introduced directly into an oven 13 in which a heat treatment crosslinks the binder and stabilizes the product. Other heat treatments may be envisaged without departing from the scope of the present invention.

Moreover, on leaving the oven the felt may be cut or packaged depending on the uses envisaged.

The problem at the basis of the invention lies at the outlet of downstream conveyors 11, 12, before the felt 6 is introduced into the oven 13.

This is because, at that point, the felt 6 is highly compressed—its density is typically about 100 kg/m$^3$—so that it has a tendency to loosen in the gap left open between the downstream conveyors 11, 12 and the oven 13.

As already mentioned, various solutions have been proposed to remedy this problem.

Figure 2:
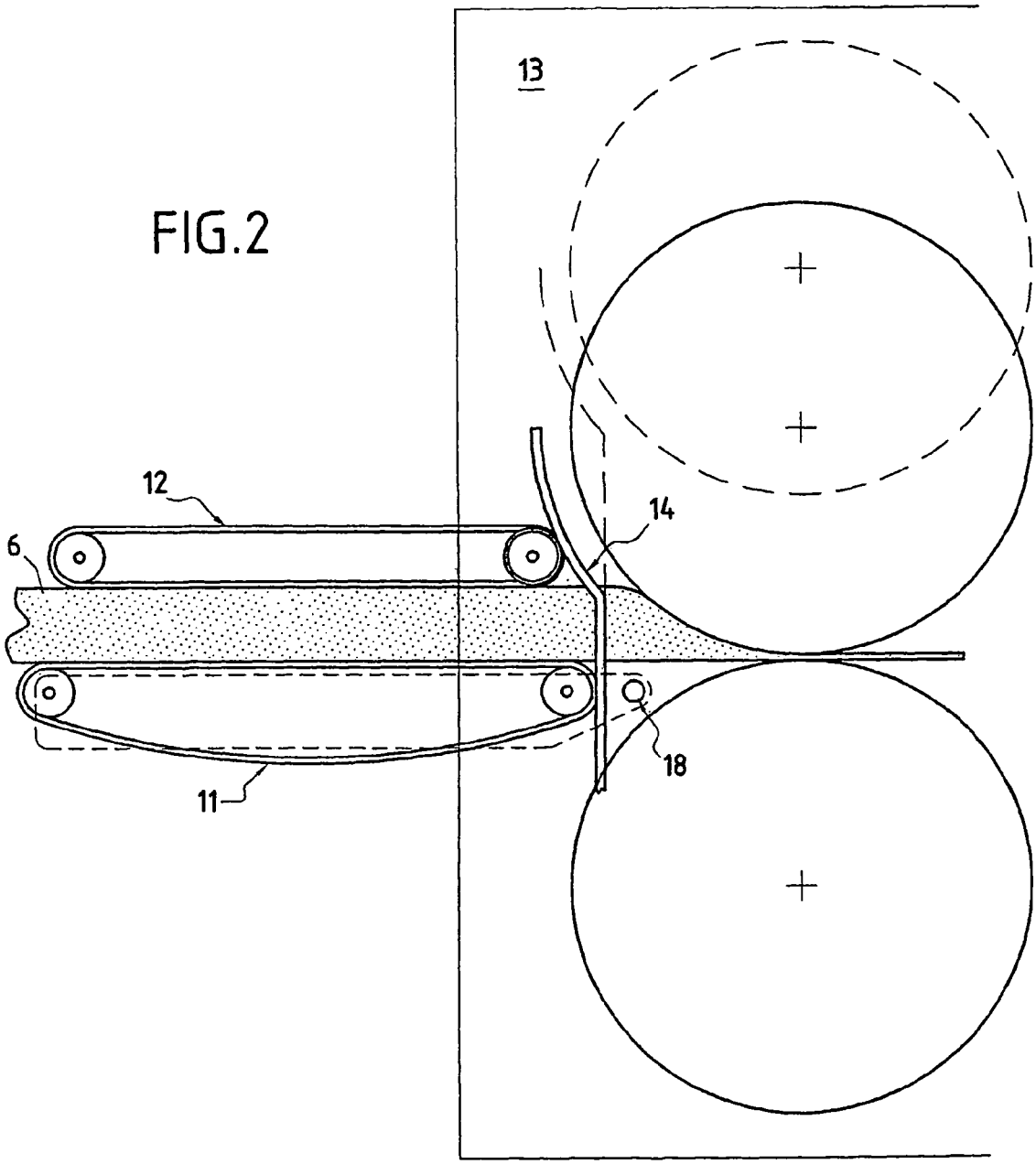
FIG. 2 is a partial view of a plant comprising a unit according to the invention.

The present invention, illustrated in greater detail in FIG. 2, solves such a problem in a novel, inventive and unexpected manner.

This figure shows in particular the downstream conveyors 11, 12 and the felt 6, which is moved between the conveyors in the direction of the arrow.

The oven 13 is limited symbolically by dots.

Placed between the conveyors 11, 12 and the oven 13 is, according to the invention, a means 14 intended to prevent decompression of the felt 6 in this region, the means 14 comprising at least one cam whose profile is suitable for keeping a constant and minimum distance between the conveyors 11, 12 and the oven 13.

To do this, the upper conveyor 12 is kept pressed against the cam 14, for example by cylinders (not shown) which are themselves actuated by one or more motors (not shown). This arrangement makes it possible to absorb any expansion of the various elements. Moreover, the cylinders make it possible to keep the chain of the conveyor taut whatever the operating position. Furthermore, the upper conveyor 12 can move vertically, thereby allowing various thicknesses of felt 6 to be manufactured.

Preferably, the cam 14 is rigidly linked to a stationary element of the oven (not shown), which may, however, be moved vertically in the thickness direction of the felt to be manufactured.

At the lower downstream conveyor 11, cylinders (not shown) may also be provided so as to push said conveyor 11 against the cam 14 and/or keep it at the same level as the web located in the oven 13.

Moreover, the lower conveyor 11 is itself rigidly linked to a stationary element of the oven via a link shown symbolically at 18.

Figure 3:
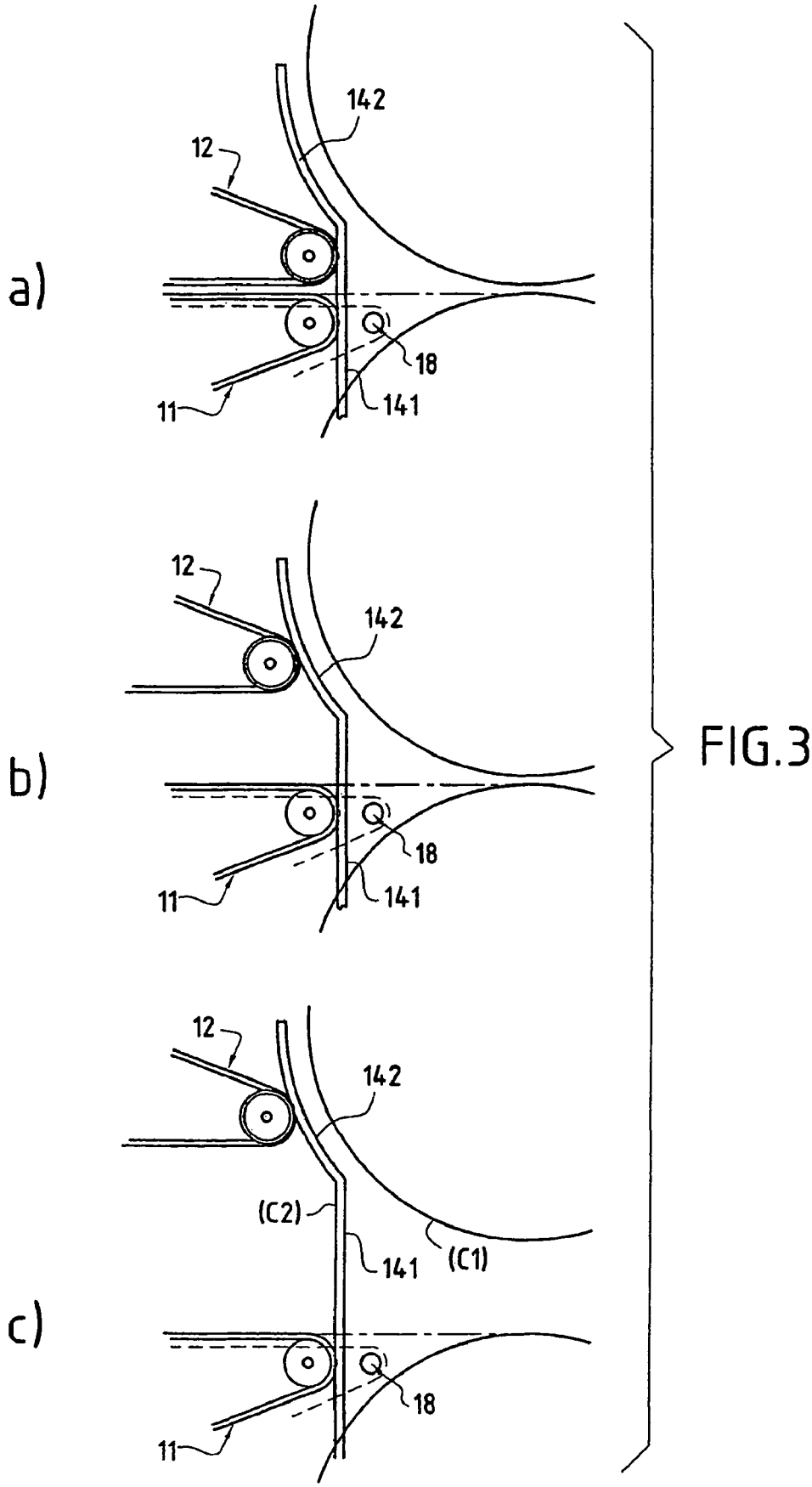
FIG. 3 is a diagram of the unit according to the invention in several operating situations.

Further features of the invention will be understood on examining FIG. 3, which shows the upper downstream conveyor 12 in three possible positions (a), (b) and (c). The lower downstream conveyor 11 can only be slightly adjusted heightwise; the amplitude of its vertical movement is intended for the sole purpose of adjustment with respect to the belt of the conveyor (not shown) in the oven 13.

In the case of positions (a) and (b), which correspond to operating positions, the cam 14 is itself in a first position shown in solid lines.

These positions correspond to the minimum and maximum thicknesses of the felt that can be manufactured.

Position (c) is a position of maximum separation between the conveyors. It is a maintenance position in which the cam 14 is in position C2 and the upper roll of the oven 13 is in position C1.

In all the configurations, the upper downstream conveyor 12 is pushed against the cam 14 which, being rigidly linked to an element such as the upper roll of the oven 13, thus makes it possible to keep the conveyor 12 at a constant distance from said roll. The profile of the cam 14 also makes it possible to keep the upper conveyor 12 at a minimum distance from the oven 13, whatever the thickness of the felt 6 to be treated.

This profile comprises a vertical straight portion 141 above which is a curved portion 142, the curvature of which is close or even identical to that of the upper roll of the oven 13. The straight portion 141 may extend over the height of the end region of the upper conveyor 12 in the low position, as well as over the height of the end region of the lower conveyor 11.

Of course, this profile is given here by way of illustration, and other cam profiles may be used without departing from the scope of the invention provided that they fulfill the abovementioned function of maintaining a minimum separation position with respect to the oven 13.

Again by way of illustration, the density of the felt upstream of the conveyors 11, 12 is about 10 kg/m$^3$. On leaving the oven 13, it is typically between 10 and 200 kg/m$^3$.

The thickness of the felt on entering the conveyors 9, 10 is between 240 mm and 1200 mm; finally, that is to say at the inlet of the oven 13, the thickness of the felt may be between 20 and 300 mm. The end product may have a thickness of between 10 and 500 mm.

The fibers vary very considerably in length; their diameter is between 3.5 microns and 5 microns.

The speed of the felts of the conveyors may be between 1.5 and 40 m/min.

Figure 4:
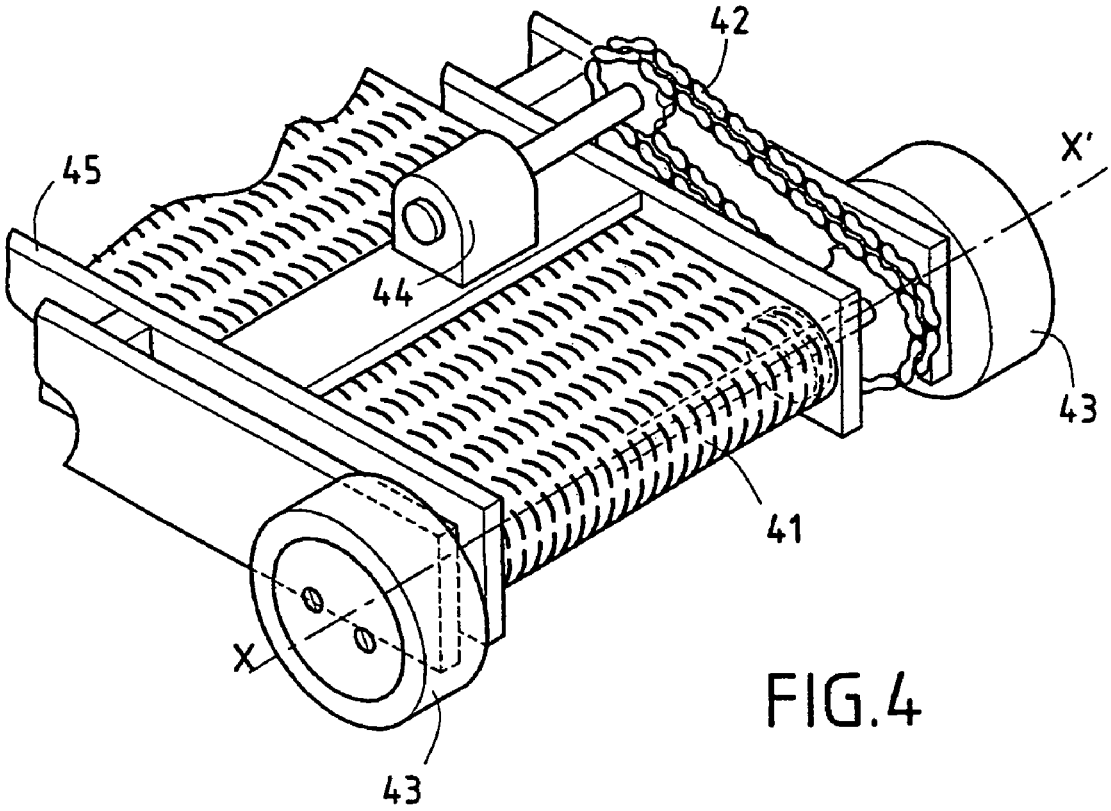
FIG. 4 is a perspective view of the upper downstream conveyor.

FIG. 4 shows in perspective the upper downstream conveyor 12. This conveyor is shown by itself, and on that side intended to feed the oven with felt, the oven not being shown. This conveyor comprises a metal link belt 41 which comes directly into contact with the felt in the case of the conveyor, said belt itself being driven by a chain sprocket, not visible in FIG. 4 but which can be imagined beneath the belt and placed on the X-X' axis, said chain sprocket comprising toothed wheels, one of which is driven by a drive chain 42, said chain itself being driven by means of a motor 44 fixedly connected to the frame 45 of the conveyor. Two cylindrical cam followers 43 (possibly having, for example, a diameter of 120 mm) are fastened to the frame on each side of the latter. The circumference of each follower can rotate freely about the axis of the follower (that is to say the X-X' axis). It is these followers which are intended to come into contact with the cams 14 according to the invention. The fact that the circumference of the followers is free to rotate limits any friction when the position of the conveyor is modified in the vertical direction, although the followers are bearing on the respective cams.

Figure 5:
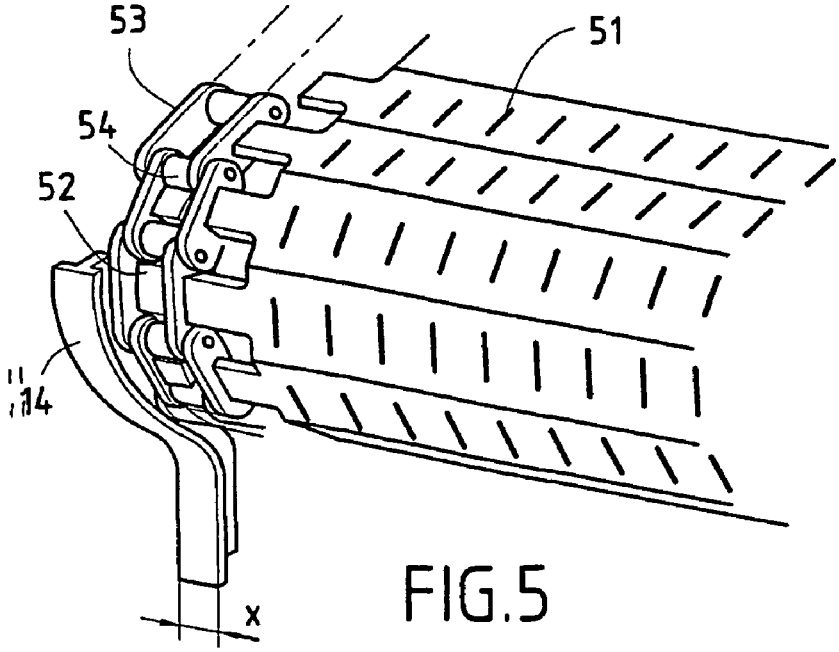
FIG. 5 is a perspective view of a part of the device intended to receive felt from the downstream conveyors.

FIG. 5 shows in perspective part of the device intended to receive the felt coming from the downstream conveyors, and part of which has been shown in FIG. 4. This FIG. 5 shows only the left-hand part of the upper receiving roll of the oven. It has to be imagined that there is an equivalent right-hand part symmetrical with the left-hand part. For the sake of simplicity, within the context of the present application, the term "roll" refers to the end part of the conveying device receiving the felt coming from the downstream conveyors. As may be seen in FIG. 5, (perforated metal lamellae) 51 receive the felt and drive it into the oven. These lamellae are driven by a sprocket (not visible in the figure but which may be imagined beneath the lamellae and in the axis of the roller), said sprocket comprising toothed wheels 52 driving a link chain 53 and rollers 54, the lamellae being fastened to said chain. FIG. 5 shows a cam 14 according to the invention, intended to receive the cam followers 43 seen in FIG. 4. This cam is fastened and fixedly connected to the frame of the oven. There is another cam, placed symmetrically with respect to it, in the right-hand part of the device, not shown in FIG. 5. Another cam is intended to receive the left-hand cam follower 43 shown in FIG. 4. By way of example, these cams may have a width ("x" in FIG. 5) of 40 mm.

The invention claimed is:

1. A unit for manufacturing felt formed from crosslinked mineral fibers, comprising:

at least one pair of conveyors formed by a lower conveyor and an upper conveyor placed opposite each other and configured to compress the felt in at least one direction;

means for heat treating the felt after the felt has passed through the conveyors, the means for heat treating comprising at least one roller;

at least one means for preventing decompression of the felt placed in a region between the conveyors and the means for heat treating, the means for preventing decompression comprising at least one cam having a profile for keeping a predetermined distance between the conveyors and the means for heat treating, wherein at least one of the conveyors is rigidly connected to one element of the means for heat treating, and the at least one cam is configured to move with a corresponding movement of the roller.

2. The unit as claimed in claim 1, wherein at least one of the conveyors is kept pressed against the at least one cam by cylinders.

3. The unit as claimed in claim 1, wherein the at least one cam is configured to move at least one of vertically and horizontally with the corresponding movement of the at least one roller.

4. The unit as claimed in claim 1, wherein the lower conveyor is rigidly connected to the one element of the means for heat treating by a linking means.

5. The unit as claimed in claim 1, wherein the at least one cam has a portion of curvature substantially identical to that of the at least one roller of the means for heat treating, the at least one roller being placed opposite the at least one cam.

6. The unit as claimed in claim 5, wherein the at least one cam further includes a straight portion lying vertically below the curved portion, and wherein the at least one cam bears on the upper conveyor.

7. The unit as claimed in claim 5, wherein the upper conveyor, the at least one cam, and the element of the means for heat treating to which the at least one cam is linked are configured to move vertically to be configured to manufacture felt of different thicknesses.

8. A process for manufacturing felt formed from sized mineral fibers, comprising:

compressing, by a compression device, the fibers in at least one direction;

heat treating the fibers, by a roller of a heat treatment device, after compressing the fibers to stabilize the fibers;

preventing decompression of the fibers between the compressing and the heat treating, by a cam having a profile configured to keep a predetermined distance between the compression device and the heat treatment device; and moving the cam with a corresponding movement of the roller.

9. The process as claimed in claim 8, wherein the compression device is kept pressed against the cam.

10. The process as claimed in claim 8, wherein the felt is compressed at least one of longitudinally and in a thickness direction.

11. The process as claimed in claim 8, wherein the manufactured felt has a thickness of between 10 and 500 mm.

12. The process as claimed in claim 8, wherein a minimum distance between the compression device and an inlet of an oven is about 5 mm.

13. A unit for manufacturing felt formed from crosslinked mineral fibers, comprising:

at least one pair of conveyors formed by a lower conveyor and an upper conveyor placed opposite each other and configured to compress the felt in at least one direction;

means for heat treating the felt after the felt has passed through the conveyors;

at least one cam disposed between the conveyors and the means for heat treating, said cam having a profile for keeping a predetermined distance between the conveyors and the means for heat treating, whatever the thickness of the felt to be treated, to prevent decompression of the fibers between the compression and the heat treatment, wherein at least one of the conveyors is rigidly connected to one element of the means for heat treating.

14. The unit as claimed in claim 13, wherein at least one of the conveyors is kept pressed against the cam by cylinders.

15. The unit as claimed in claim 13, wherein the cam is rigidly linked to a portion of the means for heat treating which is configured to move at least one of vertically and horizontally.

16. The unit as claimed in claim 13, wherein the lower conveyor is rigidly connected to the one element of the means for heat treating by a linking means.

17. The unit as claimed in claim 13, wherein the cam has a curved portion of curvature substantially identical to that of a wheel of the means for heat treating, the wheel being placed opposite the cam.

18. The unit as claimed in claim 17, wherein the cam further includes a straight portion lying vertically below the curved portion, and wherein the cam bears on the upper conveyor.

19. The unit as claimed in claim 17, wherein the upper conveyor, the cam, and an element of the means for heat treating to which the cam is linked are configured to move vertically.

20. A process for manufacturing felt formed from sized mineral fibers, comprising:

compressing, by a compression device, the fibers in at least one direction;

heat treating the fibers, by a heat treatment device, after compressing the fibers to stabilize the fibers; and linking the compression device and the heat treatment device to keep a predetermined distance between the compression device and the heat treatment device via a cam disposed between the compression device and the heat treatment device;

keeping the compression device pressed against the cam while the compression device is translated with respect to the heat treatment device, said cam having a profile suitable for keeping said predetermined distance between the compression device and the heat treatment device regardless of the thickness of the felt to be treated.

21. The process as claimed in claim 20, wherein the felt is compressed at least one of longitudinally and in a thickness direction.

22. The process as claimed in claim 20, wherein the manufactured felt has a thickness of between 10 and 500 mm.

23. The process as claimed in claim 20, wherein a minimum distance between the compression device and an inlet of an oven is about 5 mm.

24. A unit for manufacturing felt formed from crosslinked mineral fibers, comprising:

at least one pair of conveyors formed by a lower conveyor and an upper conveyor placed opposite each other and configured to compress the felt in at least one direction;

means for heat treating the felt after the felt has passed through the conveyors, the means for heat treating including at least one roller for receiving the felt after the felt has passed through the conveyors; and a cam disposed between the upper conveyor and the at least one roller of the means for heat treating, wherein the lower conveyor is rigidly connected to one element of the means for heat treating, and the cam has a curved portion of curvature substantially identical to that of the at least one roller of the means for heat treating, for keeping a constant and minimum distance between the conveyors and the at least one roller of the means for heat treating regardless of a thickness of the felt to be treated, to prevent decompression of the fibers between compression and heat treatment.

25. A process for manufacturing felt formed from sized mineral fibers, comprising:

compressing the fibers in at least one direction by a compression device, the compression device including at least one pair of conveyors formed by a lower conveyor and an upper conveyor placed opposite each other;

heat treating the fibers, by a heat treatment device, to stabilize the fibers after compressing the fibers, the heat treatment device including at least one roller for receiving the felt after the felt has passed through the conveyors; and keeping a constant and minimum distance between the upper conveyor and the at least one roller of the heat treatment device in order to prevent decompression of the fibers between the compressing and the heat treating, wherein the lower conveyor is rigidly connected to one element of the heat treatment device, a cam is disposed between the compression device and the heat treatment device, and the cam has a curved portion of curvature substantially identical to that of the at least one roller of the heat treatment device for keeping the constant and minimum distance regardless of a thickness of the felt to be treated.

26. The unit as claimed in claim 1, wherein the predetermined distance between the conveyors and the means for heat treating is a constant distance.

27. The unit as claimed in claim 1, wherein the predetermined distance between the conveyors and the means for heat treating is a minimum distance.

28. The process as claimed in claim 8, wherein the predetermined distance between the compression device and the heat treatment device is a constant distance.

29. The process as claimed in claim 8, wherein the predetermined distance between the compression device and the heat treatment device is a minimum distance.

30. The unit as claimed in claim 13, wherein the predetermined distance between the conveyors and the means for heat treating is a constant distance.

31. The unit as claimed in claim 13, wherein the predetermined distance between the conveyors and the means for heat treating is a minimum distance.

32. The process as claimed in claim 20, wherein the predetermined distance between the compression device and the heat treatment device is a constant distance.

33. The process as claimed in claim 20, wherein the predetermined distance between the compression device and the heat treatment device is a minimum distance.

34. The unit as claimed in claim 24, wherein at least one of the conveyors is kept pressed against the cam by cylinders.

35. The unit as claimed in claim 24, wherein the cam is configured to move at least one of vertically and horizontally with a corresponding movement of the at least one roller.

36. The unit as claimed in claim 24, wherein the lower conveyor is rigidly connected to the one element of the means for heat treating by a linking means.

37. The unit as claimed in claim 24, wherein the cam has a portion of curvature substantially identical to that of the at least one roller of the means for heat treating, the at least one roller being placed opposite the cam.

38. The unit as claimed in claim 28, wherein the cam further includes a straight portion lying vertically below the curved portion, and the cam bears on the upper conveyor.

39. The unit as claimed in claim 28, wherein the upper conveyor, the cam, and the element of the means for heat treating to which the cam is linked are configured to move vertically to be configured to manufacture felt of different thicknesses.

40. The process as claimed in claim 25, wherein the compression device is kept pressed against the cam.

41. The process as claimed in claim 25, wherein the felt is compressed at least one of longitudinally and in a thickness direction.

42. The process as claimed in claim 25, wherein the manufactured felt has a thickness of between 10 and 500 mm.

43. The process as claimed in claim 25, wherein a minimum distance between the compression device and an inlet of an oven is about 5 mm.

* * * * *

UNITED STATES PATENT AND TRADEMARK OFFICE

CERTIFICATE OF CORRECTION

PATENT NO. : 7,354,541 B2
APPLICATION NO. : 10/381199
DATED : April 8, 2008
INVENTOR(S) : Francois Bouquet et al.

It is certified that error appears in the above-identified patent and that said Letters Patent is hereby corrected as shown below:

IN THE ABSTRACT

Item (57), Please cancel the Abstract in its entirety and insert therefor:

--ABSTRACT

A unit and process of manufacturing felts formed from crosslinked mineral fibers. The unit includes at least one pair of conveyors formed by a lower conveyor and an upper conveyor placed opposite each other and configured to compress the felt in at least one direction. A heat treating device heat treats the felt after the felt has passed through the conveyors. At least one mechanism is placed in a region between the conveyors and the heat treatment device, to prevent decompression of the felt in this region. The mechanism includes at least one cam having a profile suitable for keeping a constant and minimum distance between the conveyors and the heat treatment device, and at least one of the conveyors is rigidly connected to one element of the heat treatment device.--

Signed and Sealed this

Sixteenth Day of November, 2010

David J. Kappos

David J. Kappos
*Director of the United States Patent and Trademark Office*